US010767844B1

(12) United States Patent
Ke

(10) Patent No.: US 10,767,844 B1
(45) Date of Patent: Sep. 8, 2020

(54) PLV LAMP

(71) Applicant: ZHEJIANG SETEC LIGHTING CO. LTD, Shaoxing (CN)

(72) Inventor: Jianfeng Ke, Shaoxing (CN)

(73) Assignee: ZHEJIANG SETEC LIGHTING CO. LTD, Shaoxing (CN)

( * ) Notice: Subject to any disclaimer, the term of this patent is extended or adjusted under 35 U.S.C. 154(b) by 0 days.

(21) Appl. No.: 16/627,777

(22) PCT Filed: Sep. 24, 2019

(86) PCT No.: PCT/CN2019/107512

§ 371 (c)(1),
(2) Date: Dec. 31, 2019

(51) Int. Cl.

| | |
|---|---|
| ***F21S 2/00*** | (2016.01) |
| ***F21V 19/02*** | (2006.01) |
| ***F21V 23/06*** | (2006.01) |
| ***F21V 21/30*** | (2006.01) |
| ***F21V 17/12*** | (2006.01) |

(52) U.S. Cl.
CPC ..... *F21V 23/06* (2013.01); *F21V 17/12* (2013.01); *F21V 21/30* (2013.01)

(58) Field of Classification Search
CPC ..... F21V 23/06; F21V 21/30; F21V 17/12
See application file for complete search history.

(56) References Cited

U.S. PATENT DOCUMENTS 9,159,521 B1 * 10/2015 Chen ..... F21V 7/0025
2013/0155666 A1 * 6/2013 Yeh ..... F21V 14/065 362/187

FOREIGN PATENT DOCUMENTS

CN 101701671 A * 5/2010
CN 102287638 A * 12/2011
CN 202215975 U * 5/2012
CN 103032689 A * 4/2013

OTHER PUBLICATIONS

CN202215975U machine translation May 2012 (Year: 2012).*
CN102287638 machine translation, 2011 (Year: 2011).*
CN0170617 machine translation (Year: 2010).*
CN 103032689 A machine translation (Year: 2013).*

* cited by examiner

*Primary Examiner* — Tracie Y Green
(74) *Attorney, Agent, or Firm* — Bayramoglu Law Offices LLC

(57) ABSTRACT

A PLV lamp includes a lamp cup, a lamp body, and a lamp cap, wherein the lamp cup is rotationally connected with the lamp body, and the lamp body is stretchable and matched with the lamp cap. The rotatable connection between the lamp cup and the lamp body is realized through two movable shafts. The two movable shafts have a gap formed therebetween and are arranged at a bottom of the lamp cup. The lamp body is provided with a movable shaft base to be matched with the gap, and the two movable shafts are connected with the movable shaft base.

8 Claims, 7 Drawing Sheets

PLV LAMP

CROSS REFERENCE TO THE RELATED APPLICATIONS

This application is based on International Application No. PCT/CN2019/107512, filed on Sep. 24, 2019, the entire contents of which are incorporated herein by reference.

TECHNICAL FIELD

The application relates to a powerless vertical (PLV) lamp, in particular to a PLV lamp having a lamp cup capable of rotating on a stretchable lamp body which is rotationally matched with a lamp cap.

BACKGROUND

Existing PLV lamp typically comprise a lamp cup, a lamp body, and a lamp cap, wherein the lamp cup is a lamp shade, the lamp body is a middle part of the PLV lamp, and the lamp cap is a tail part of the PLV lamp. The existing PLV lamp is longitudinally fixed in general, that is, the PLV lamp is inserted into a socket from bottom to top with the lamp cup facing downwards. The PLV lamp horizontally emit light when installed horizontally, and in this case, it is necessary to add a reflecting cover, which results in much inconvenience in use.

The lamp body of the existing PLV lamp is generally fixed and cannot be stretched or retracted as needed.

The lamp cap and the lamp body of the existing PLV lamp are fixedly matched generally, so that the lamp body is unable to rotate relative to the lamp cap as needed.

SUMMARY

The objective of the application is to provide a PLV lamp to realize the technical purpose of rotation of a lamp cup on a lamp body.

The PLV lamp includes a lamp cup, a lamp body, and a lamp cap, wherein the lamp cup is rotationally connected with the lamp body, and the lamp body is stretchable and matched with the lamp cap.

The rotatable connection between the lamp cup and the lamp body may be realized through a rotary part, the rotary part may be arranged between the lamp cup and the lamp body, and the rotary part may be fixedly matched with the lamp cup and may be movably matched with the lamp body.

A buckle hole and a wire hole may be formed in a position, matched with the rotary part, of the lamp cup, a buckle may be arranged at a position, matched with the lamp cup, of the rotary part, and a rotary shaft may be arranged at a position, movably matched with the lamp body, of the rotary part.

The rotatable connection between the lamp cup and the lamp body may be realized through two movable shafts, two movable shafts have a gap formed therebetween and may be arranged at a bottom of the lamp cup, the lamp body may be provided with a movable shaft base to be matched with the gap, and the two movable shafts may be connected with the movable shaft base.

The rotatable connection between the lamp cup and the lamp body may be realized through an installation part arranged at a bottom of the lamp cup, the lamp cup has a limit end, and the lamp body has an installation end matched with the installation part and may be provided with a limit block which corresponds to the limit end of the lamp cup.

The lamp body may include an external movable part and an internal fixed part, wherein the internal fixed part may be provided with a positioning strip, the external movable part may be provided with a positioning groove matched with the positioning strip, and a rubber ring storage groove used for storing a rubber ring may be formed above the positioning strip.

The lamp body may include an external movable part, an external rotary sleeve, and an internal threaded sleeve, wherein the external movable part may be fixed outside the external rotary sleeve internally provided with internal threads, the internal threaded sleeve may be matched with the lamp cap and has an external surface provided with external threads matched with the internal threads, and the internal threaded sleeve may be matched with the lamp cap.

The lamp body may include an external movable part, an internal fixed part, and an elastic positioning pin, wherein a positioning groove and a positioning hole may be formed in the external movable part, the internal fixed part may be provided with a positioning strip matched with the positioning groove and the elastic positioning pin corresponding to the positioning hole, and a rubber ring storage groove used for storing a rubber ring may be formed above the positioning strip.

The lamp cap may be a screwed lamp cap or a plug type lamp cap.

The lamp body may be in shaft connection with the lamp cap.

The application has the following beneficial effects: the lamp cup may be able to rotate by a certain angle on the lamp cap and thus can be adjusted by a certain angle to be adaptively installed when horizontally inserted, so that no reflecting cover needs to be added; the lamp body may be stretchable and thus can stretch or retract as needed to adjust a lighting position; and the lamp body and the lamp cap may be in shaft connection and thus can be rotated as needed to meet actual requirements.

Figure 1:
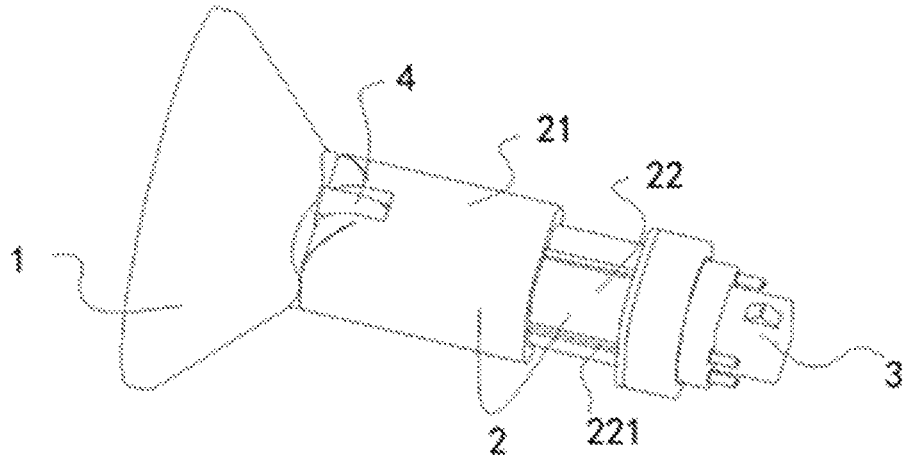
FIG. 1 is a schematic diagram of a PLV lamp in Embodiment 1.
Figure 2:
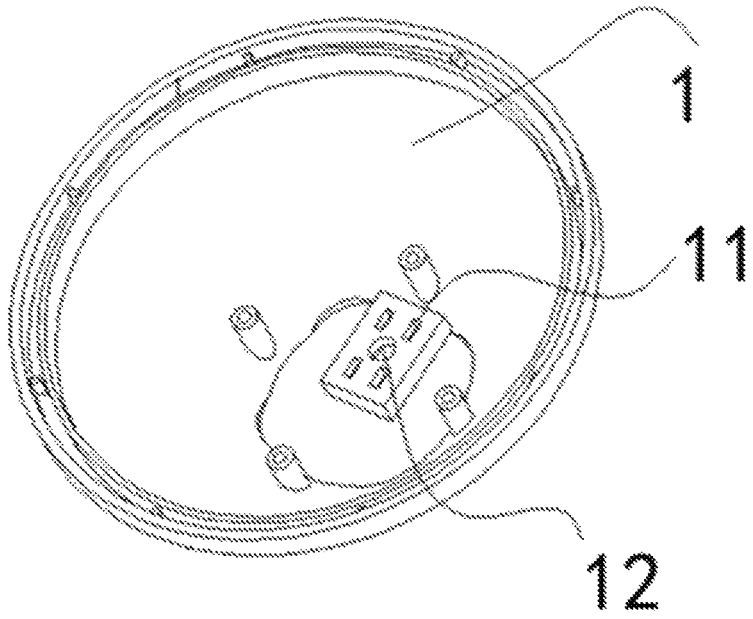
FIG. 2 is a schematic diagram of a lamp cup in FIG. 1.
Figure 3:
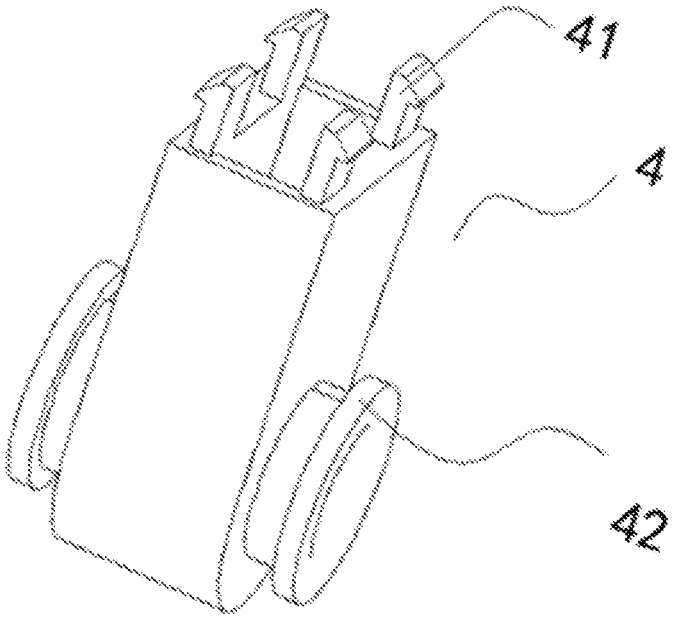
FIG. 3 is a schematic diagram of a rotary part of the PLV lamp in FIG. 1.
Figure 4:
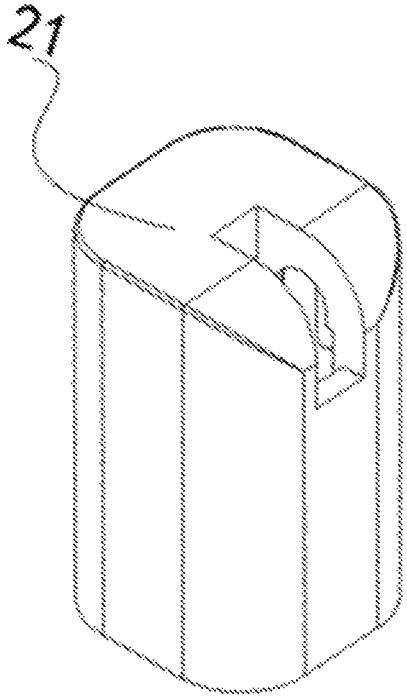
FIG. 4 is a schematic diagram of an external movable part of the PLV lamp in FIG. 1.
Figure 5:
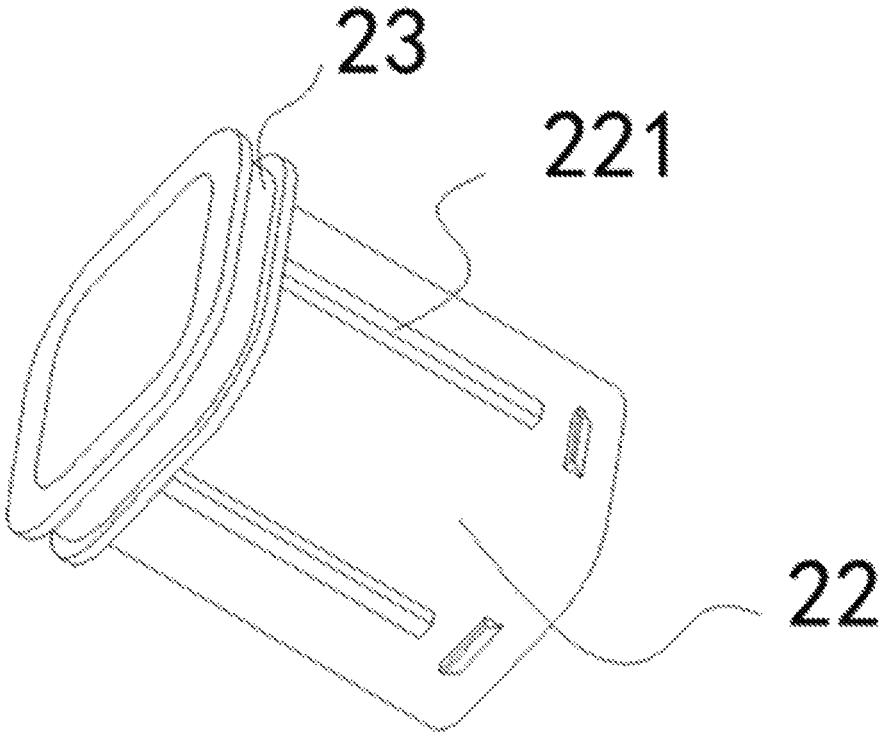
FIG. 5 is a schematic diagram of an internal fixed part of the PLV lamp in FIG. 1.
Figure 6:
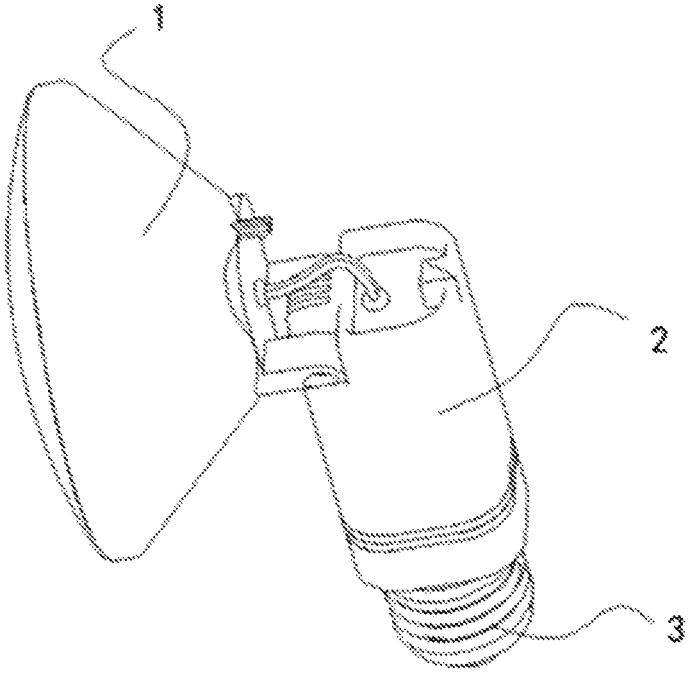
FIG. 6 is a schematic diagram of a PLV lamp in Embodiment 2.
Figure 7:
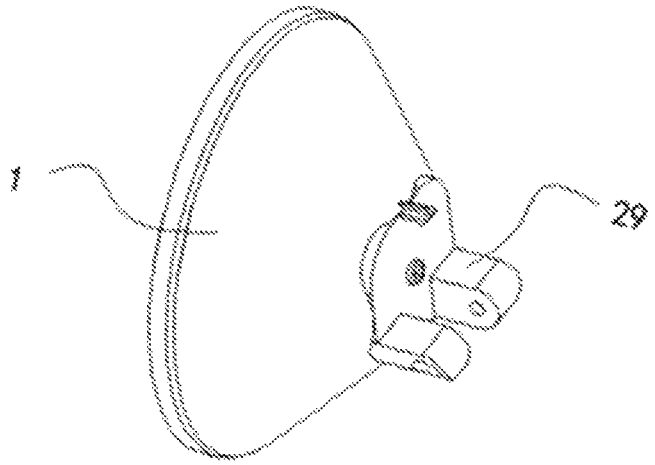
FIG. 7 is a schematic diagram of a lamp cup of the PLV lamp in FIG. 6.
Figure 8:
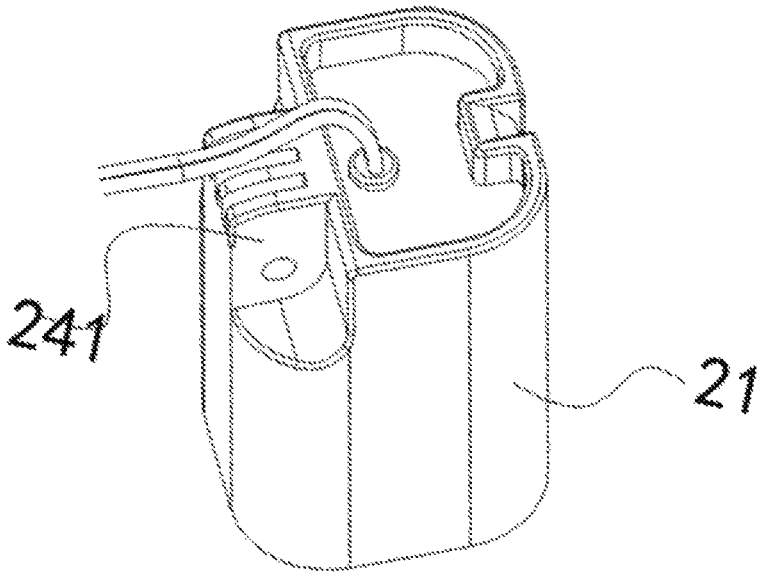
FIG. 8 is a schematic diagram of an external movable part of the PLV lamp in FIG. 6.
Figure 9:
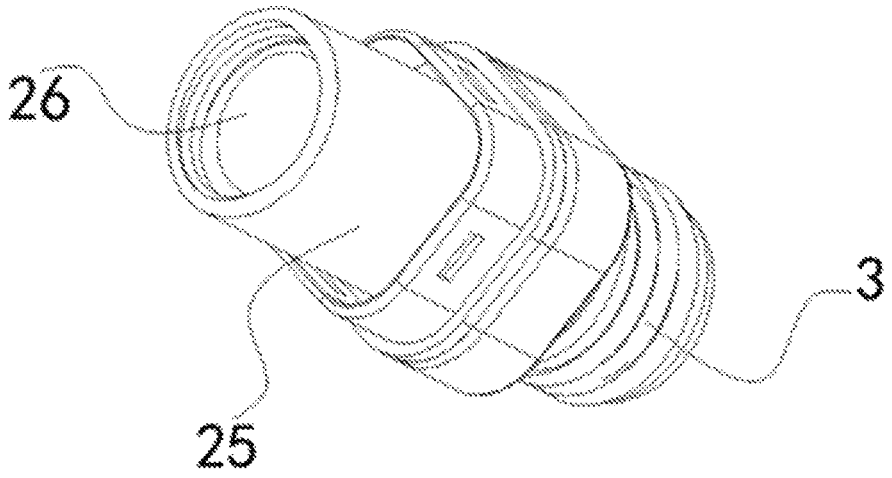
FIG. 9 is a matching diagram of an external rotary sleeve, an internal threaded sleeve, and a lamp cap of the PLV lamp in FIG. 6.
Figure 10:
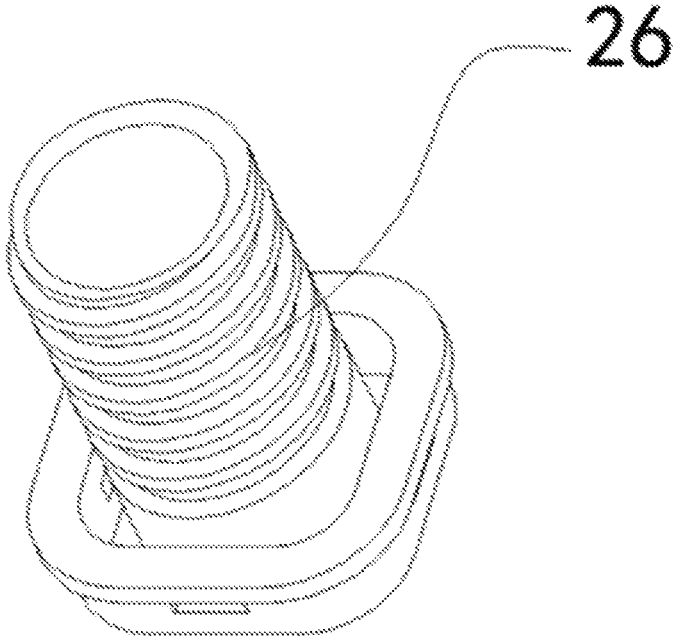
FIG. 10 is a schematic diagram of the internal threaded sleeve.

Reference numbers: 1, lamp cup; 11, buckle hole; 12, wire hole; 13, installation part; 14, limit end; 2, lamp body; 21, external movable part; 211, positioning hole; 22, internal fixed part; 221, positioning strip; 23, rubber ring storage groove; 241, movable shaft base; 25, external rotary sleeve; 26, internal threaded sleeve; 27, elastic positioning pin; 28, installation end; 29, movable shaft; 3, lamp cap; 4, rotary part; 41, buckle; 42, rotary shaft.

DETAILED DESCRIPTION OF THE EMBODIMENTS

Embodiment 1

Referring to FIG. 1 to FIG. 5, a PLV lamp comprises a lamp cup 1, a lamp body 2, and a lamp cap 3, wherein the lamp cup 1 primarily fulfills a lamp shade effect, and a lamp shade, a radiating cup, and an aluminum substrate are arranged in the lamp cup 1; the lamp body 2 is used for accommodation and driving and is used as a transition part of the lamp cup 1 and the lamp cap 3; and the lamp cap 3 is used for inserting the whole lamp into a corresponding socket.

A rotary part 4 is arranged between the lamp cup 1 and the lamp body 2, buckle holes 11 and a wire hole 12 are formed in a position, matched with the rotary part 4, of the lamp cup 1, four buckles 41 are arranged at a position, matched with the lamp cup 1, of the rotary part 4, and the lamp cup 1 and the lamp body 2 are matched with each other in this way. A rotary shaft 42 is arranged at a position, movably matched with the lamp body 2, of the rotary part 4, and the lamp cup 1 is rotationally matched with the lamp body 2 through bolts installed on the rotary shaft 42. The rotary shaft 42 and the buckles 41 are respectively arranged at two ends of the rotary part. The four buckles 41 are arranged at a quadrangular end of the rotary part 4 and are respectively located at four corners, and every two of the four buckles are symmetrical with each other. Correspondingly, the number of the buckle holes 11 is four, and the buckling direction of the buckles 41 and the buckle holes 11 is not consistent with the rotation direction of the rotary shaft 42, so that the buckles will not disengage from the buckle holes when the rotary shaft is rotated.

The lamp body includes an external movable part 21 and an internal fixed part 22, wherein the external movable part 21 is matched with the lamp cup, and the internal fixed part 22 is matched with the lamp cap 3; the internal fixed part 22 is provided with positioning strips 221, the external movable part 21 is provided with positioning grooves matched with the positioning strips, the external movable part is able to horizontally and stably stretch or retract on the internal fixed part through the cooperation between the positioning grooves and the positioning strips 221, and in actual application, the positions of the positioning grooves and the positioning strips can be exchanged; and a rubber ring storage groove 23 used for storing a rubber ring is formed above the positioning strips, and the rubber ring is arranged in the rubber ring storage groove to realize a damping effect.

The lamp cap in this embodiment is a screwed lamp cap and is matched with the lamp body in a conventional shaft connection manner, the prior art can be referred to for a specific shaft connection structure, and the specific model of the lamp cap can be selected as needed.

Please refer to the accompanying drawings for the specific matching relation of the lamp cup, the lamp body, and the lamp cap, and the matching relation of these parts is fully expressed in the accompanying drawings.

Embodiment 2

Referring to FIG. 6 to FIG. 10, a PLV lamp comprises a lamp cup 1, a lamp body 2, and a lamp cap 3.

Two movable shafts 29 having a gap formed therebetween are arranged at the bottom of the lamp cup 1, the lamp body is provided with a movable shaft base 241 to be matched with the gap, and the movable shafts 29 are connected with the movable shaft base 241 through bolts.

The lamp body 2 includes an external movable part 21, an external rotary sleeve 25, and an internal threaded sleeve 26, wherein the external movable part 21 is matched with the lamp cup 1, the external rotary sleeve 25 is in transition fit with the external movable part 21 and the internal threaded sleeve 26, and the internal threaded sleeve 26 is matched with the lamp cap 3; and the external movable part 21 is fixed outside the external rotary sleeve 25 and is provided with a movable shaft base 241 to be matched with the lamp cup 1. Internal threads are arranged in the external rotary sleeve 25, and external threads matched with the internal threads are arranged on the outer surface of the internal threaded sleeve 26 which is matched with the lamp cap 3. In such a matching manner similar to a lipstick tube, when the internal threaded sleeve 26 matched with the lamp cap 3 is rotated, the external rotary sleeve 25 drives the external movable part 21 to stretch or retract, so that the lamp body 2 stretches or retracts accordingly.

The lamp cap 3 in this embodiment is a screwed lamp cap and is matched with the lamp body 2 in a conventional shaft connection manner, the prior art can be referred to for a specific shaft connection structure, and the specific model of the lamp cap 3 can be selected as needed.

Please refer to the accompanying drawings for the specific matching relation of the lamp cup 1, the lamp body 2, and the lamp cap 3, and the matching relation of these parts is fully expressed in the accompanying drawings.

Embodiment 3

Figure 11:
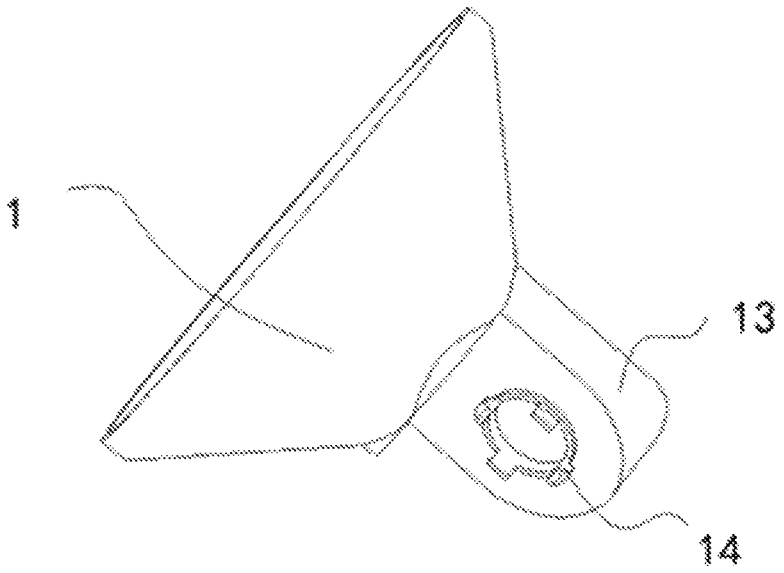
FIG. 11 is a schematic diagram of a PLV lamp in Embodiment 3.
Figure 12:
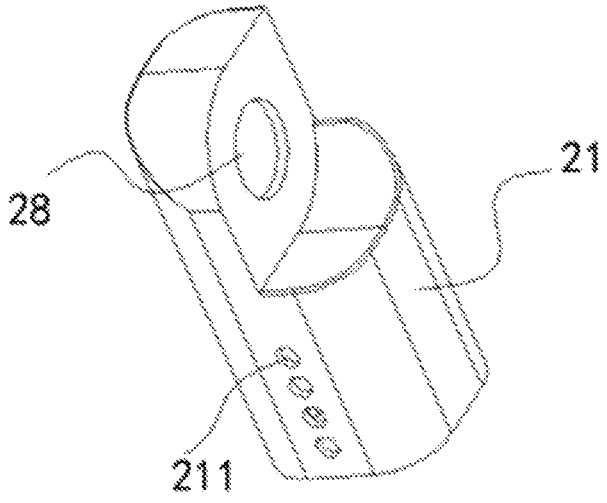
FIG. 12 is a schematic diagram of a lamp cup of the PLV lamp in FIG. 11.
Figure 13:
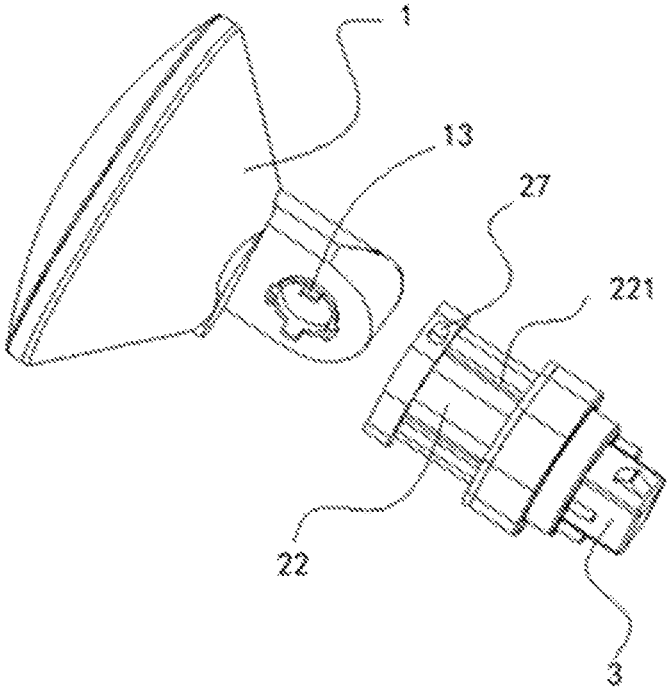
FIG. 13 is a matching diagram of an internal fixed part, an elastic positioning pin, the lamp cup, and a lamp cap of the PLV lamp in FIG. 11.

Referring to FIG. 11 to FIG. 13, a PLV lamp comprises a lamp cup 1, a lamp body 2, and a lamp cap 3.

An installation part 13 is arranged at the bottom of the lamp cup 1 and has a limit end for fulfilling a rotation limit effect, the lamp body 2 has an installation end 28 matched with the installation part 13 and is provided with a limit block which corresponds to the limit end 14 of the lamp cup 1 and is not shown in figures, the limit end 14 and the limit block are conventionally switched to be applied to the lamp to be in cooperation with each other, so that the limit block is not shown in the figures. However, mechanical designers can clearly understand the structure according to their appreciation.

The lamp body 2 includes an external movable part 21, an internal fixed part 22, and an elastic positioning pin 27, wherein positioning grooves and positioning holes 211 are formed in the external movable part 21, and the positioning grooves are located in the external movable part 21 and are not shown in figures; the internal fixed part 22 is provided with positioning strips 221 matched with the positioning grooves and the elastic positioning pin 27 corresponding to the positioning holes 211; and a rubber ring storage groove 23 used for storing a rubber ring is formed above the positioning strips 221, so that the rubber ring fulfills a damping effect.

The lamp cap 3 in this embodiment is a plug type lamp cap and is in fixed to or in shaft connection with the lamp body 2.

The lamp cap 3 in the above three embodiments is the screwed lamp cap or the plug type lamp cap as needed.

In order to make the objectives, technical solutions, and advantages of the embodiments of the present application clearer, the technical solutions in the embodiments of the present application are clearly and completely described above with reference to the drawings in the embodiments of the application. The embodiments are part of the embodiments of the present invention, but not all of them. The components of embodiments of the present invention, generally described and illustrated in the drawings herein, can be arranged and designed in a variety of different configurations.

Therefore, the above detailed description of the embodiments of the present invention provided in the drawings is not intended to limit the scope of the claimed invention, but merely to show selected embodiments of the present invention. Based on the embodiments of the present invention, all other embodiments obtained by a person of ordinary skill in the art without making creative work belong to the protection scope of the present invention.

What is claimed is:

1. A PLV lamp, comprising a lamp cup, a lamp body, and a lamp cap, wherein, the lamp cup is rotationally connected to the lamp body through two movable shafts, and the lamp body is stretchable and matched with the lamp cap;

a gap is formed between the two movable shafts, and the two movable shafts are arranged at a bottom of the lamp cup; and the lamp body is provided with a movable shaft base to be matched with the gap, and the two movable shafts are connected to the movable shaft base.

2. A PLV lamp, comprising a lamp cup, a lamp body, and a lamp cap, wherein, the lamp cup is rotationally connected to the lamp body through a rotary part, and the lamp body is stretchable and matched with the lamp cap;

the rotary part is arranged between the lamp cup and the lamp body, and the rotary part is fixedly matched with the lamp cup and is movably matched with the lamp body;

a buckle hole and a wire hole are formed in a first position, wherein the lamp cup is matched with the rotary part at the first position;

a buckle is arranged at the first position; and a rotary shaft is arranged at a second position, wherein the rotary part is movably matched with the lamp body at the second position.

3. A PLV lamp, comprising a lamp cup, a lamp body, and a lamp cap, wherein, the lamp cup is rotationally connected to the lamp body through an installation part, and the lamp body is stretchable and matched with the lamp cap;

the installation part is arranged at a bottom of the lamp cup;

the lamp cup has a limit end;

the lamp body has an installation end matched with the installation part, and the lamp body is provided with a limit block; and the limit block corresponds to the limit end of the lamp cup.

4. The PLV lamp according to claim 1, wherein, the lamp body comprises an external movable part, an external rotary sleeve, and an internal threaded sleeve;

the external movable part is fixed outside the external rotary sleeve; the external rotary sleeve is internally provided with internal threads; the internal threaded sleeve is matched with the lamp cap, and the internal threaded sleeve has an external surface provided with external threads matched with the internal threads; and the internal threaded sleeve is matched with the lamp cap.

5. The PLV lamp according to claim 2, wherein, the lamp body comprises an external movable part and an internal fixed part;

the internal fixed part is provided with a positioning strip, and the external movable part is provided with a positioning groove matched with the positioning strip; and a rubber ring storage groove configured to store a rubber ring is formed above the positioning strip.

6. The PLV lamp according to claim 3, wherein, the lamp body comprises an external movable part, an internal fixed part, and an elastic positioning pin;

a positioning groove and a positioning hole are formed in the external movable part, and the internal fixed part is provided with a positioning strip and the elastic positioning pin, wherein the positioning strip is matched with the positioning groove, and the elastic positioning pin corresponds to the positioning hole; and a rubber ring storage groove configured to store a rubber ring is formed above the positioning strip.

7. The PLV lamp according to claim 1, wherein, the lamp cap is a screwed lamp cap or a plug type lamp cap.

8. The PLV lamp according to claim 1, wherein, the lamp body is coupled to the lamp cap.

* * * * *